United States Patent [19]

Brill et al.

[11] Patent Number: 4,946,073

[45] Date of Patent: Aug. 7, 1990

[54] BEVERAGE AND ICE DISPENSING METHOD AND APPARATUS

[75] Inventors: Frank D. Brill, Fox Lake; Benjamin D. Miller, Chicago; Thaddeus M. Jablonski, Palatine, all of Ill.; Doulgas F. Marsh, Raymond, Me.; Richard E. Marsh, West Chicago, Ill.

[73] Assignee: Restaurant Technology, Inc., Oak Brook, Ill.

[21] Appl. No.: 176,491

[22] Filed: Apr. 1, 1988

[51] Int. Cl.[5] ..... B65B 3/04

[52] U.S. Cl. ..... 222/129.4; 222/430; 222/439

[58] Field of Search ..... 141/369, 370, 94, 234; 222/431, 432, 424.5, 430, 438, 129, 439; 221/96

[56] References Cited

U.S. PATENT DOCUMENTS

| | | | |
|---|---|---|---|
| 307,629 | 11/1884 | Church . | |
| 1,517,923 | 12/1924 | Sylvester . | |
| 1,669,624 | 5/1928 | Moore et al. . | |
| 2,879,811 | 3/1959 | Parraga . | |
| 3,181,739 | 6/1965 | Dye . | |
| 3,227,313 | 1/1966 | Morena . | |
| 3,853,244 | 12/1974 | Neumann | 222/129.1 |
| 3,913,792 | 10/1975 | Brill et al. | 222/144.5 |
| 3,987,824 | 10/1976 | Zehnder | 141/99 |
| 4,174,872 | 11/1979 | Fessler | 319/290 |
| 4,226,269 | 10/1980 | Carr et al. | 141/361 |
| 4,319,441 | 3/1982 | Credle | 53/131 |
| 4,319,698 | 3/1982 | Tomiyama et al. | 222/129.1 |
| 4,386,640 | 6/1983 | Carr et al. | 141/361 |
| 4,496,087 | 1/1985 | Marks | 222/638 |
| 4,537,336 | 8/1985 | Verduin et al. | 222/641 |
| 4,590,975 | 5/1986 | Credle, Jr. | 141/1 |
| 4,641,763 | 2/1987 | Landers et al. | 222/129.1 |
| 4,658,872 | 4/1987 | Ellis | 141/34 R |
| 4,712,591 | 12/1987 | McCann et al. | 141/88 |
| 4,738,885 | 4/1988 | Belland | 141/378 X |
| 4,753,277 | 6/1988 | Holcomb et al. | 141/83 X |

FOREIGN PATENT DOCUMENTS 572926 6/1924 France .

OTHER PUBLICATIONS

Remcor Products Company Catalog, (Publication date unknown).

*Primary Examiner*—Andres Kashnikow
*Assistant Examiner*—Kevin P. Weldon
*Attorney, Agent, or Firm*—Jenner & Block

[57] ABSTRACT

A beverage and ice bodies dispensing apparatus is described in which vertically-oriented chutes throuch which ice bodies are dispensed are associated with spouts. Gates within the chutes are used to dispense predetermined quantities of ice bodies into the cup to be filled. A storage cabinet for ice is located above and connected to the chute for refilling the chutes with ice bodies. In accordance with one embodiment, the force of the falling ice is utilized to maintain the proper position off, and/or position the cup to be filled.

19 Claims, 7 Drawing Sheets

BEVERAGE AND ICE DISPENSING METHOD AND APPARATUS

FIELD OF THE INVENTION

The present invention relates to a method and apparatus for the dispensing of beverages and ice. More particularly, this invention relates to such a method and apparatus wherein ice is dispensed from a vertically-oriented chute separate from, but oriented with, the spout from which the beverage is dispensed. A gate arrangement in the chute dispenses any one of a preselected quantity of ice. This provides more efficient filling of cups with ice and beverage since the ice bodies and beverage are dispensed at the same cup location.

BACKGROUND OF THE INVENTION

Nearly all restaurants serve iced beverages. In many of these restaurants, standard fountain-type dispensers are used to dispense beverages into a cup. These dispensers may have a plurality of spouts, each spout being dedicated to a certain type of beverage. These beverages include various flavors of carbonated beverages, both regular and diet, water, juice drinks and the like. Both beverage and ice, usually cubes or crushed, are placed into the cup before being served to the customer. A quantity of ice is typically placed into the cup before the beverage is dispensed so that splashing is minimized.

The dispensing of beverage and ice into a cup may typically be a manually intensive operation. Specifically, restaurant personnel select an empty cup of the desired size from a stack. Next, ice may be taken out of a bin, either with a scoop or by using the cup as a scoop. The restaurant personnel may then have to adjust the quantity of ice which was placed in the cup, either by adding more ice if not enough was placed into the cup or by taking out some ice if too much was placed into the cup. If too much ice is left in the cup and served to the customer, the customer may become dissatisfied in not getting enough beverage. If too little ice is placed into the cup, the ice may melt quickly and the beverage may not be cool enough thereby also causing customer dissatisfaction. Also, ice hoppers are usually positioned at or below waist level, requiring restaurant personnel to bend over frequently to retrieve the ice.

After an appropriate quantity of ice is placed into a cup, the cup must be properly positioned under a separate beverage dispenser. Many of these dispensers have a lever connected to a spout. The cup is pressed against the lever and beverage begins to become dispensed from the spout. When an appropriate amount of beverage has been dispensed, the cup is brought out of contact with the lever and the spout is closed.

Several systems have been described for dispensing ice in predetermined quantities. In U.S. Pat. No. 4,226,269, for example, a vertically-oriented delivery duct for ice contains one or more control elements which are selectively insertable into the delivery duct to correspondingly adjust the amount of ice delivered by a concurrent opening of a lower closure member of the delivery duct. These control elements comprise one or more tines for minimizing crushing and breaking of ice in the delivery duct. A storage hopper for ice is located above the delivery duct, and contains an auger type agitator for assisting in refilling the delivery duct. The same system is also disclosed in U.S. Pat. No. 4,386,640, a continuation of the patent just described.

A similar ice dispensing system is described in U.S. Pat. No. 4,496,087, in which a delivery passage is closed at a selected level by one of a series of dividers along the chute. A closure normally closing the delivery end of the delivery passage is removed to permit the ice in the passage between the delivery and the actuated divider to be dispensed. An ice storage bin is located above the delivery passage and an agitator is operated for a preselected period of time each time ice is delivered from the delivery passage. The agitator is also activated even if no ice has been dispensed for a long period of time to prevent conglomeration of ice in the bin.

These systems, however, are only used to dispense ice and do not provide for the dispensing of beverage in conjunction with the ice. Therefore, restaurant personnel must place a cup to be filled at the ice dispenser and then carry it to a beverage spout.

A combination ice/beverage dispenser is described in U.S. Pat. No. 4,590,975, in which an automatic beverage dispensing assembly includes two subassemblies. The first assembly includes an automatic cup dropper and the second subassembly includes an automatic beverage dispensing means and an automatic conveyor. An automatic ice dispenser may be added. The ice dispenser consists of an inclined chute which is connected at its top end to an ice compartment and at its lower end to an opening through which ice is dispensed into a cup. The chute may contain three removable stop members, the stop member nearest the opening being normally closed. If a large or small cup is inserted, one of the appropriate stop members is energized. The stop member nearest the opening is then opened and ice caught intermediate this stop member and the energized stop member is dispensed. Next, the beverage dispensing valve assembly then dispenses the beverage for a predetermined period of time depending upon whether a particular drink ordered was a small or large size. Such a device is not suitable for a plurality of combination ice/beverage dispensing stations located side by side, for example, and in close relationship so that only a relatively small area is occupied.

A need exists for a method and apparatus that dispenses both ice and beverage efficiently for use in a quick-service (fast food) restaurant that is compact and has a plurality of ice/beverage dispensing stations.

A need exists for a method and apparatus that automatically dispenses both ice and beverage to a cup at a single location that is capable of handling cups of widely varying sizes.

A need also exists for an ice and beverage dispenser that utilizes the force of ice falling into a cup to maintain the cup at a proper position for filling with beverage.

A need also exists for a method and apparatus for dispensing ice and beverage that reduces the time it takes for restaurant personnel to dispense such beverages.

SUMMARY OF THE INVENTION

In accordance with the present invention, a method and apparatus for dispensing ice and beverage at the same cup location is provided. The apparatus can accommodate cups of widely varying sizes and utilizes the force of falling ice to maintain the proper cup position for beverage dispensing.

In accordance with one aspect of the invention, an apparatus for dispensing ice and beverage into a cup at a single cup location is provided. The apparatus includes a plurality of spaced apart spouts (usually beverage dispensing valves) in a predetermined array, which may be in a linear or curved row, for example for dispensing beverages, each spout capable of dispensing at least one type of beverage. A plurality of vertically disposed chutes, usually equal in number to the spouts, is provided for dispensing ice bodies. Each chute is associated with a different one of the spouts and each chute and associated spout define a dispensing location at which a cup can be filled with ice and beverage at a single cup location. Each chute has a lower end positioned relative to its corresponding spout to allow the beverage and ice bodies to be dispensed at a single cup location. Each chute has an upper end which communicates with a storage hopper for receiving ice bodies into the chute. As used herein, the term "ice bodies" includes ice cubes, crushed ice and other forms of ice suitable for serving in beverages. "Beverage" means any liquid drink, whether or not carbonated or flavored and includes water. By "vertically disposed" is meant that the chute has at least sufficient vertical inclination so that ice bodies contained therein will travel by gravity to the lower end of the chute.

For each chute, there is a dispensing gate which is selectively insertable laterally near the lower end of the chute to prevent the dispensing of ice bodies from the chute. The dispensing gate is movable between a first open position and a second closed position in which a portion of the dispensing gate has been inserted into the chute to prevent the flow of ice bodies out of the chute. For each chute there is also at least one and preferably a plurality of divider gates, each of which is selectively insertable into the chute at preselected positions intermediate the upper and lower ends of the chute. Each divider gate is movable between a first open position which allows ice bodies to fall past the divider gate and a second closed position in which a portion of the divider gate has been inserted into the chute to prevent or substantially prevent the flow of ice bodies therepast. The number of different preselected quantities of ice bodies capable of being dispensed from each chute is equal to the number of divider gates that are associated with that chute.

In operation, the dispensing gate is closed and the chute is filled with ice bodies from the hopper. To dispense a quantity of ice bodies, one of the divider gates is moved into its second or closed position. Therefore, a quantity of ice bodies are segregated in the space between the chosen divider gate and the dispensing gate. The dispensing gate is moved to its first or open position and the segregated ice bodies drop out of the chute and into a cup located underneath. Additional ice is prevented from being dispensed because the chosen divider gate prevents the flow of additional ice bodies when in its second or closed position. After dispensing, the dispensing gate is moved back into its second or closed position and the chosen divider gate is moved to its first or open position. Ice bodies are then free to fall through the chute past the previously closed divider gate to refill the chute. The ice bodies remain in the chute until another dispensing operation occurs. Each one of the divider gates, used in conjunction with the dispensing gate, segregates a different, preselected volume of ice bodies in the chute.

The sequencing of the dispensing gate and the divider gates is controlled by a control system. The control panel may comprise an individual control for each spout and chute. The control system may include a manually operable override switch to discontinue dispensing of the beverage or for selectively dispensing an additional amount of beverage than the predetermined amounts.

In accordance with another aspect of the invention, the upper openings of each of the chutes may be aligned along one of the bottom edges of the hopper. The chutes are preferably aligned substantially parallel to each other, with the divider gates comprising solid, planar members that block only a portion of the cross-sectional area of the chute when the divider gates and dispensing gates are inserted into the chutes. The divider gates and dispensing gates can be selectively movable with dual-action pneumatic cylinders. The rear of the chutes may comprise a front panel to which a semi-cylindrically shaped element is removably mounted to the front panel. The front panel is provided with a plurality of slots through which the divider gates and dispensing gates are insertable and the front portion of the chutes is mounted over the front panel.

Further, agitation means are provided in the hopper to assist in delivering ice into the chutes for refilling the chutes. For example, the agitation means may comprise dual agitators mounted in a side by side arrangement in the storage hopper. The paths of the agitators may overlap. The agitators are activated for a predetermined time when ice bodies are dispensed from one of the chutes. The predetermined time can be related to the quantity of ice bodies dispensed from the chute and the location of the chute opening in said hopper. In accordance with one embodiment of the invention, any one of four preselected quantities of ice bodies and beverage may be dispensed at at least five dispensing locations.

In accordance with another aspect of the invention, an inclined rack is provided beneath the chutes and spouts upon which the cups are placed to be filled in an inclined position. Stops which preferably are V-shaped may be provided on the racks to position cups to be filled at the optimum filling location for each combination chute and spout station. Further, the spouts may be inclined at an acute angle relative to vertical. For reasons not understood, less foaming and better carbonation retention occurs when the beverage spout is at an acute angle from vertical and preferably an angle of about 15 degrees from vertical.

In accordance with another aspect of the invention, a plurality of spouts for dispensing beverages are aligned along a first row or linear array. A plurality of vertically disposed chutes for dispensing ice bodies, equal to the number of spouts, are aligned along a second row or linear array. The second linear array is parallel to the first linear array and the chutes are located along the second linear array in close horizontal proximity to the spouts. In this orientation, each chute is located adjacent to a different spout to allow dispensing of both ice bodies and beverage at a single cup location.

Preferably, the center-to-center distance between each of the spouts, and the center-to-center distance between each of the chutes in their respective rows is about the diameter of the largest size cup contemplated for use in connection with the beverage/ice dispenser, and optionally about an additional one-quarter inch to insure adequate clearance between cups. Usually, the cup size will be a 20 or 32 ounce cup or about 3.5 to 4 inches in diameter. Thus, a plurality of beverage/ice dispensing locations can be provided in a relatively small and compact area. For example, an ice beverage dispenser having seven separate ice/beverage cup filling locations may be only about 28 inches wide.

In accordance with another aspect of the invention, an apparatus is provided in which cups of different sizes may be filled at one of a plurality of spouts which are capable of dispensing a plurality of different quantities of beverages, each having associated with it a chute capable of dispensing a plurality of different, preselected quantities of ice bodies. Each different quantity of beverage has associated with it a corresponding, preselected quantity of ice bodies.

In accordance with another aspect of the invention, an inclined surface is provided for positioning the cup to be filled at any one of the chutes on the inclined surface. A stop is provided below the cup location on the inclined surface to prevent the cup from sliding down the incline. The incline is preferably sloped downwardly towards the rear of the apparatus to facilitate cup positioning. The cup is positioned on this structure, preferably by the stop, to receive ice bodies dispensed from the chute so that at least a portion of the dispensed ice bodies strike the interior sidewall of the cup, preferably towards the bottom of the cup, adjacent the stop. In this manner, the falling ice bodies create a horizontal force component towards the stop, which acts to urge the cup against the stop to insure that the cup is in proper position for beverage dispensing. The cup is therefore less likely to fall over as it is being filled. The horizontal force towards the stop also tends to move the cup against the stop if the operator has not placed the cup against the stop.

In accordance with another aspect of the invention, each of a plurality of spouts for dispensing beverages are associated with a separate vertically disposed chute for dispensing ice. Each spout and corresponding chute is positioned adjacent each other to allow the beverage and the ice bodies to be dispensed into a cup at a single cup location. Each chute is capable of dispensing a preselected quantity of ice bodies vertically downwardly into the cup. Each of the spouts are capable of dispensing a plurality of preselected, different quantities of ice bodies, each spout being oriented at an acute angle relative to vertical.

In accordance with another embodiment of the invention, a method for dispensing ice bodies and beverage into a cup at a single cup location is provided. A cup is positioned on an incline under a spout for dispensing beverages. A stop is provided on the incline for preventing the cup from sliding down the incline as the cup is being filled. Ice bodies are then dispensed into the cup from a vertically disposed chute adjacent the spout. The cup is positioned on the incline to receive the ice bodies at the base of the cup so that at least a portion of the ice bodies strike the interior sidewall of the cup, preferably towards the bottom of the cup and adjacent the stop to create a horizontal force component in a direction towards the stop. The horizontal force component urges the cup against the stop and insures that the cup is in proper position for beverage filling. The beverage is then dispensed into the cup.

Other objects and advantages of the invention will become apparent upon the following detailed description with reference to the drawings. Throughout the drawings, like reference numerals refer to like parts.

DETAILED DESCRIPTION OF THE PREFERRED EMBODIMENT

While the invention is useful in dispensing many types of beverages, the invention is especially useful in dispensing ice bodies and beverages which are commonly served in quick service restaurants. These beverages include carbonated beverages, both regular and diet, juice drinks, water and the like in which ice bodies are typically placed before being served to restaurant customers.

Figure 2:
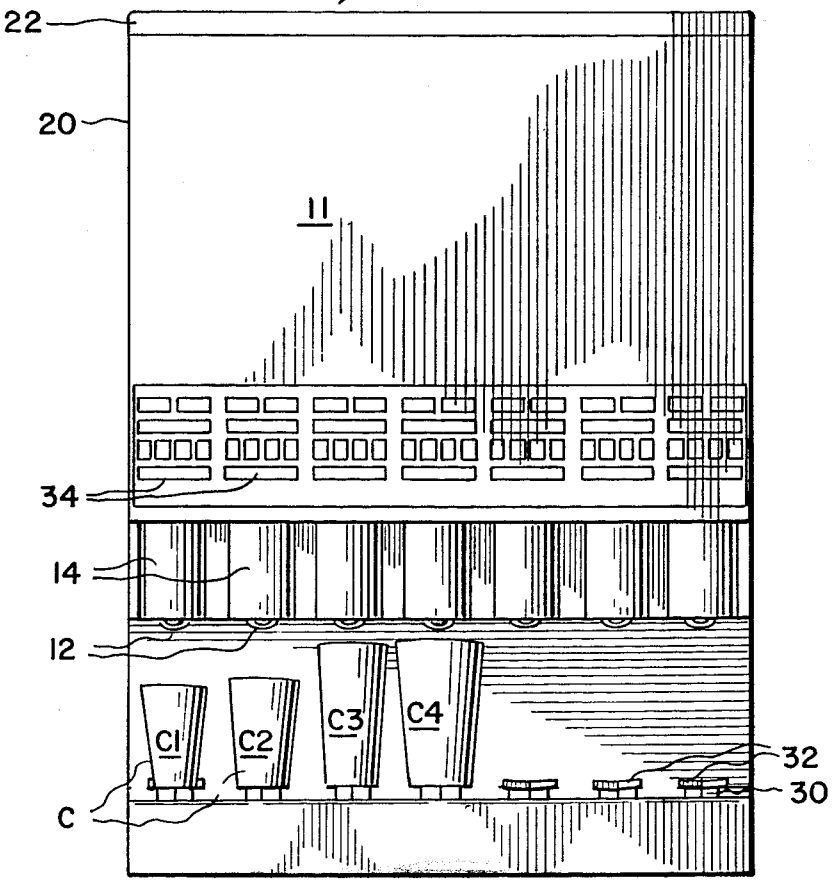
FIG. 2 is an elevated front view of the invention as illustrated in FIG. 1.
Figure 1:
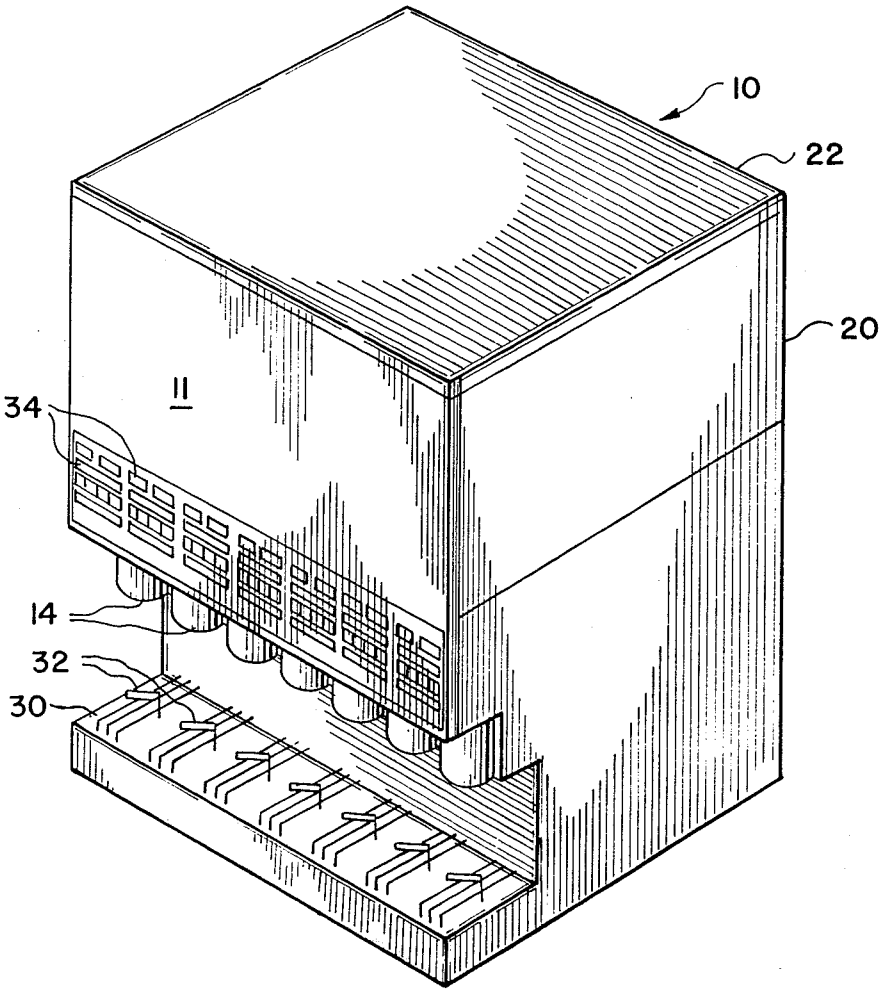
FIG. 1 is a perspective view of one embodiment of the invention.

Referring to the Figures generally and in particular to FIGS. 1-2, there is illustrated various aspects of an ice and beverage dispensing apparatus 10 (hereinafter "apparatus 10") in accordance with the invention. Apparatus 10 has seven separate locations at which cups may be filled with ice and beverage at the same cup location. A large or small number of cup filling locations could, of course, be provided, as desired.

Apparatus 10 includes a plurality (seven in this embodiment) of spouts 12 which are aligned along a linear array. The front 11 of apparatus 10 may be defined as the side at which spouts 12 are positioned while the back of apparatus 10 is the opposite side of front 11. The width of front 11 is only about 28 inches.

Each spout 12 is capable of dispensing at least one type of beverage into cups which may be positioned for filling under each spout 12. Spouts 12 may be of conventional design and are capable of being used to dispense one of several different quantities of beverage, depending on the cup size placed under spout 12. Spout 12 may be a standard beverage dispensing valve, widely used in the industry. The different nominal cup sizes that can be used with apparatus 10 may vary widely in volume. For example, the nominal cup sizes for typical regular (small), medium, large and extra large size servings are: regular—12 ounces; medium—16 ounces; large—22 ounces; and extra-large—32 ounces. These sizes are provided as an example only and can, of course, be varied. A control system discussed below is used to control the quantity of beverage dispensed from each spout, in accordance with instructions from restaurant personnel as to what cup size has been placed beneath each spout 12 so that each cup can be filled to a desired level. The various cup sizes, regular, medium, large and extra-large, are illustrated in FIGS. 2, 3, 4 and 6 and referred to by reference numerals C1, C2, C3 and C4, respectively. As illustrated in FIG. 4, spouts 12 are at an angle 0 from the vertical, which in this case is about 15 degrees.

Figure 5:
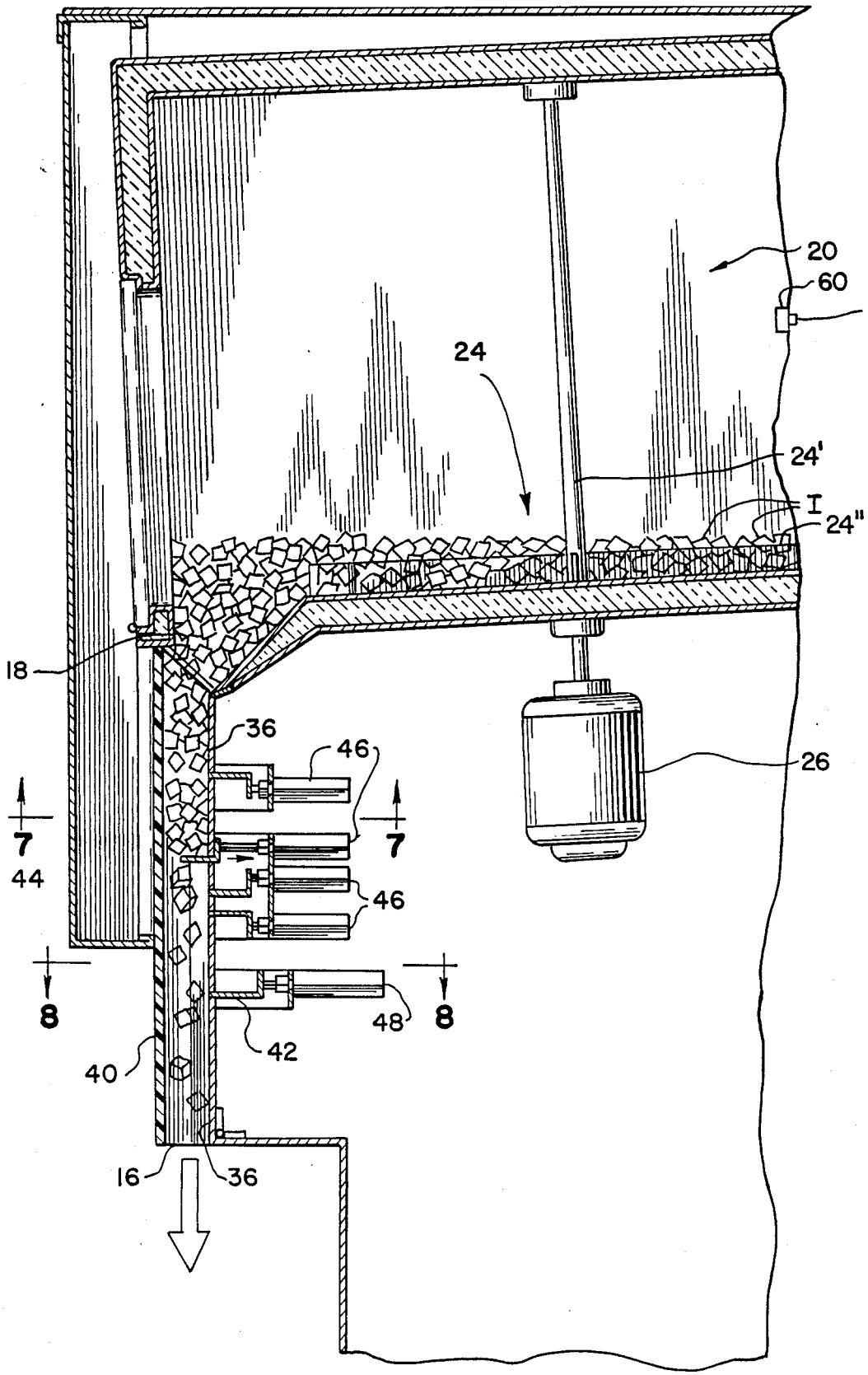
FIG. 5 is a side sectional view of the invention.
Figure 6:
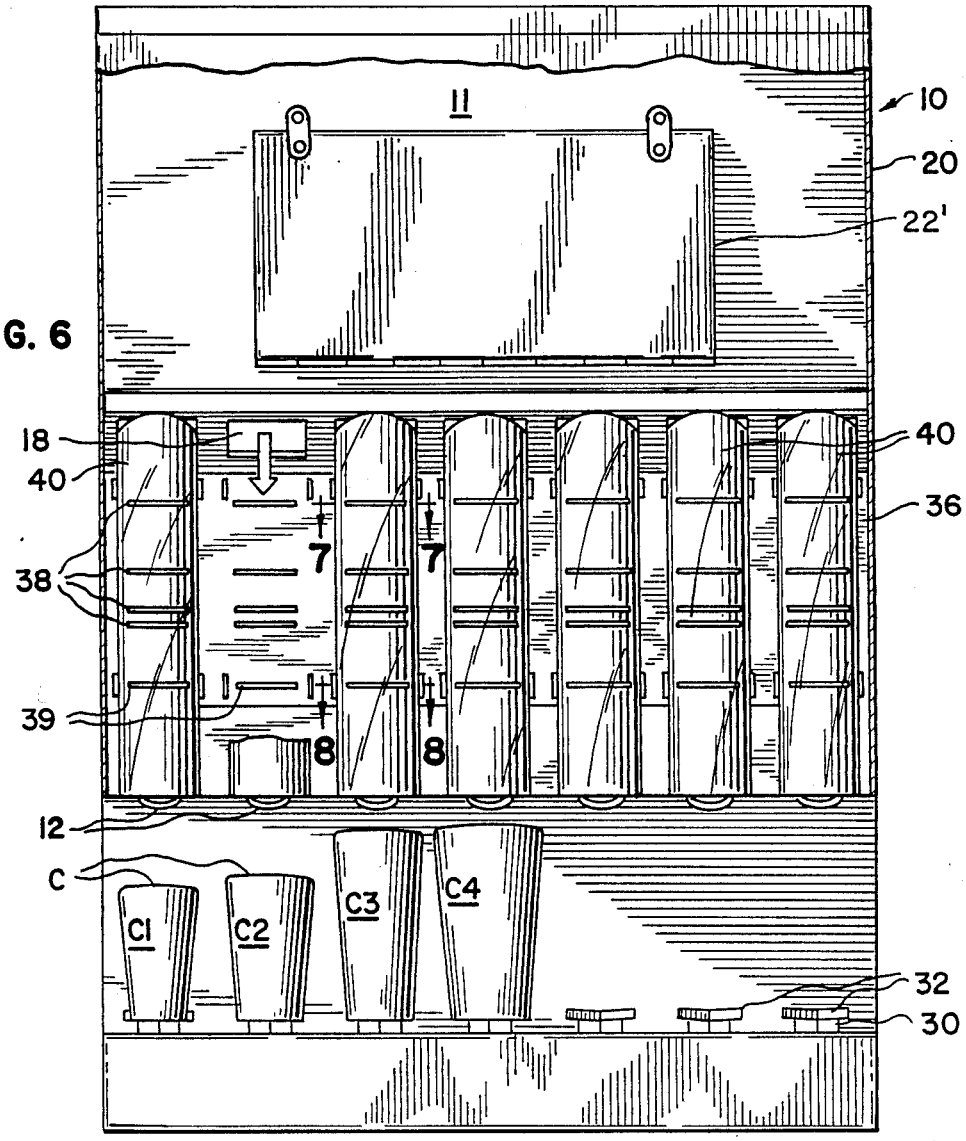
FIG. 6 is a front view illustrating the slots in the chute.

Apparatus 10 includes a storage hopper 20 for ice bodies I to be dispensed, which as shown in FIG. 5 fill only a small portion of hopper 20. If desired, of course, hopper 20 could be completely filled or substantially filled with ice I. Access to hopper 20 is provided by suitably removable cover 22 for filling hopper 20 with ice bodies I. For example, cover 22 may either be hinged to apparatus 10 or totally removable. An alternative means of access to hopper 20 may be provided by door 22' in front 11 as shown in FIG. 6. Hopper 20 may be provided with a suitable sensor to sense ice level, which in the illustrated embodiment is a temperature sensor 60 at some position along one of the walls to detect when the level of ice bodies I in hopper 20 has fallen below a certain level. When the level of ice bodies I is at or above the position of sensor 60, ice bodies I impart to sensor 60 a cold temperature which signifies that the level is at an adequate level. The control system, discussed below, is capable of checking a valve associated with sensor 60 to determine when an alarm (not shown) should be activated to inform restaurant personnel that the level has fallen below a certain level.

Figure 7:
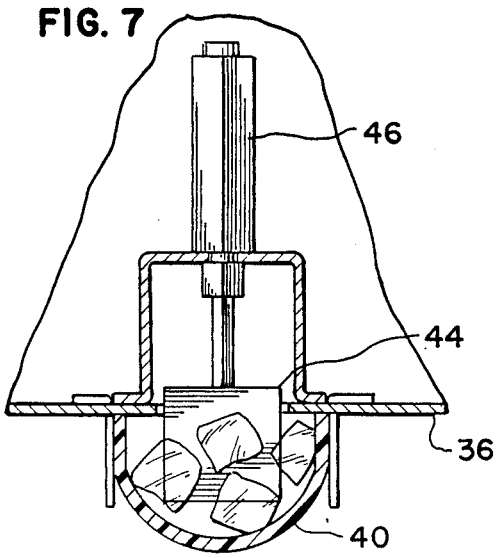
FIG. 7 is a plan view of a divider gate and cylinder along the line 7—7 in FIG. 5.
Figure 8:
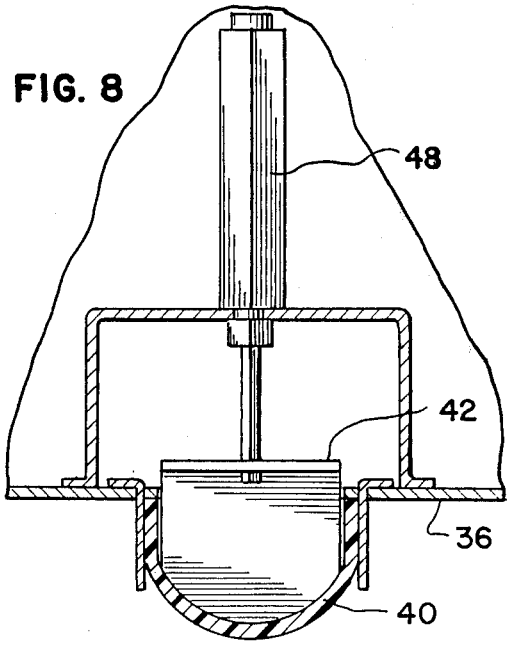
FIG. 8 is a plan view of the dispensing gate and cylinder along the line 8—8 in FIG. 5.

Adjacent each spout 12 is a separate chute 14. Each chute 14 is vertically disposed and is used for dispensing a quantity of ice bodies from hopper 20 and into cups positioned below each chute 14. In fact, in the illustrated embodiment, each chute 14 is vertical, i.e., 90 degrees from horizontal. Chute 14 and spout 12 are positioned together so that both ice bodies I and beverage B are dispensed into a cup C at a single cup location, rather than ice bodies I being dispensed at one location and beverage B being dispensed at another location requiring movement of cup C to obtain beverage therein. Each chute 14 together with its associated spout 12 define a separate dispensing location. Chute 14 has an upper end 18 opening into hopper 20 and a lower end 16 for dispensing a quantity of ice bodies I into a cup C. Ice bodies I fall by gravity from hopper 20 through upper end 18 and through chute 14. Chute 14 is defined, as FIGS. 5 and 7–8 illustrate, by a front panel 36 and a semi-cylindrical member 40. Member 40 may be removably mounted to front panel 36 which allows for relatively easy cleaning. Further, as shown in FIG. 6, member 40 may be made of transparent or semi-transparent material. Each chute 14 would, of course, be formed from a unitary piece of material.

Each chute 14 further has two types of gates to selectively restrict the flow of ice bodies through chute 14. Located near lower end 16 of chute 14, dispensing gate 42 is movable from a first position in which chute 14 is substantially clear of dispensing gate 42 and a second position in which a portion of dispensing gate 42 has been inserted into chute 14 to prevent or substantially restrict the flow of ice bodies out of chute 14. A plurality of divider 44 are selectively insertable laterally into chute 14 at preselected positions intermediate upper end 18 and lower end 16. As with dispensing gate 42, divider gates 44 are moveable between a first position which allows ice bodies to fall therepast within chute 14 and a second position in which a portion of divider gate 44 has been inserted into chute 14 to restrict and substantially prevent the flow of ice bodies I therepast. Chute 14 may be substantially clear of a divider gate 44 in the open position. Dispensing gates 42 and divider gates 44 may be constructed as solid, planar members and may be moveable between their respective first and second positions by any one of several mechanisms. Different or the same mechanisms may be used here for moving dispensing gate 42 and divider gates 44. Air solenoids or dual-action cylinders, for example, may be used. As shown in FIGS. 5 and 7–8, pneumatic cylinders may be provided. Dispensing-gate 42 may be moved by cylinder 48 and divider gates 44 may be moved by pneumatic cylinders 46.

Dispensing gate 42 and a divider gate 44 are shown in their respective second positions in FIGS. 8 and 7, respectively. In FIG. 7, a portion of divider gate 44 is shown to have been inserted into chute 14 to substantially but not completely block the cross-sectional area of chute 14. Similarly, in FIG. 8, a portion of dispensing gate 42 is shown to have been inserted into chute 14 to substantially but not completely block the cross-sectional area of chute 14.

The cross-sectional area of chute 14 does not have to be completely blocked by either divider gates 44 or dispensing gate 42 to be effective in preventing or substantially preventing the flow of ice bodies I therepast because each of ice bodies I has a certain volume that would not allow it to pass around dispensing gate 42 and divider gates 44 when each are in their respective said second positions. An advantage of not requiring dispensing gate 42 or divider gate 44 to completely block the cross-sectional area of chute 14 is that less energy is required to block off only a substantial portion of the cross-sectional area of chute 14 than to completely block off the entire cross-sectional area of chute 14. Specifically, if the entire cross-sectional area is to be blocked, divider gates 44 and dispenser gate 42 must be inserted into chute 14 with a force sufficient to penetrate through any ice bodies I in their respective lateral paths across chute 14.

As illustrated in FIG. 6, front panel 36 has a plurality of horizontally-oriented slots 38 and 39. Front panel 36 may be capable of pivotal movement along its lower edge. As front panel 36 pivots, all of the chute 14 assemblies, including the air solenoids or pneumatic cylinders 46 are carried along with front panel 36. This pivotal movement allows for ease of maintenance. Slots 38 and 39 are located parallel to each other. For convenience, only three sets of slots 38 and 39 are illustrated, although one set of slots 38 and 39 is provided for each chute 14. Slots 39 are provided for dispenser gates 42 which move through slots 39 between their first and second positions. Slots 38 are provided for divider gates 44, which move through slots 38 between their first and second position.

Slots 38, and therefore divider gates 44 are located at preselected positions from slot 39 to allow dispensing of one a plurality of different preselected quantities of ice bodies I to be dispensed from chute 14 along its radial axis between dispensing gate 42 and each one of divider gates 44 defines a different, preselected volume. For example, the volume of chute 14 along its radial axis from dispensing gate 42 and the first divider gate 44 oriented directly above dispensing gate 42 define a quantity of ice to be dispensed for a "regular" size divider; the volume between dispensing gate 42 and the second divider gate 44 directly above dispensing gate 42 define a quantity of ice to be dispensed for a "medium" size drink; the volume between dispensing gate 42 and the third divider gate 44 directly above dispensing gate 42 define a quantity of ice to be dispensed for a "large" size drink; and the volume between dispensing gate 42 and the highest divider gate 44 directly above dispensing gate 42 define a quantity of ice to be dispensed for an "extra-large" size drink. Because the void space created by the settling of ice bodies in chute 14 may vary within a certain range, any of the quantities of ice described above may themselves vary within a certain range. However, these variances do not deviate enough to create concern that either an insufficient or an excess quantity of ice bodies I will be dispensed into a cup. The void space of ice bodies I in chute 14 will also vary according to the particular shape of ice bodies I being dispensed.

The ice portions can be varied by changing the positions of divider gates 44 with respect to dispensing gate 42. This can be accomplished by changing the positions of slots 38 in front panel 36 and the positions of pneumatic cylinders 46. Front panel 36 may be constructed of various components or plates to facilitate this (not shown) or a new front panel of desired slot configuration could be provided.

Figure 3:
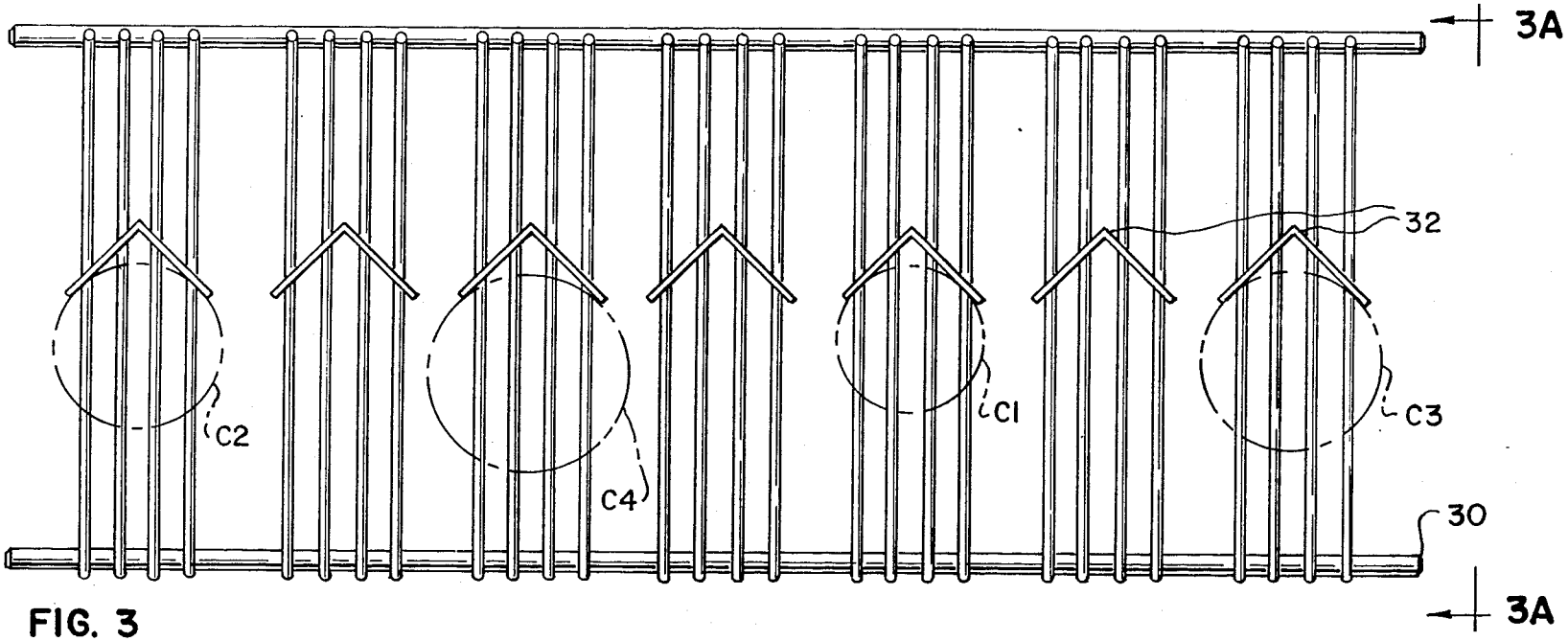
FIG. 3 is a plan view of the cup-supporting rack.
Figure 3A:
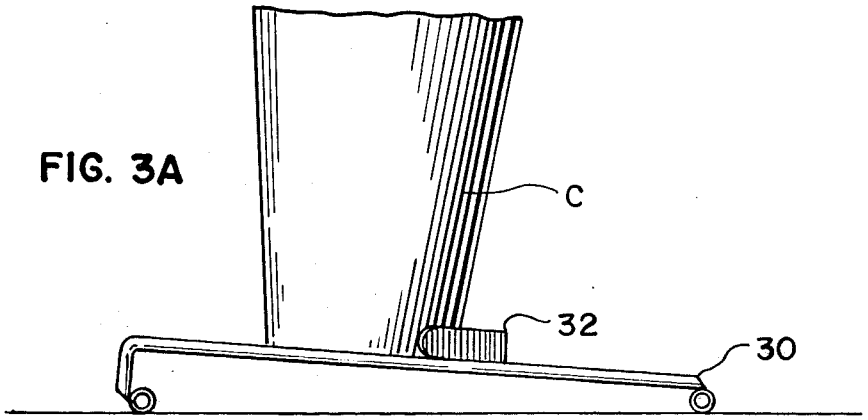
FIG. 3A is a plan view of the cup-supporting rack of FIG. 3.
Figure 4:
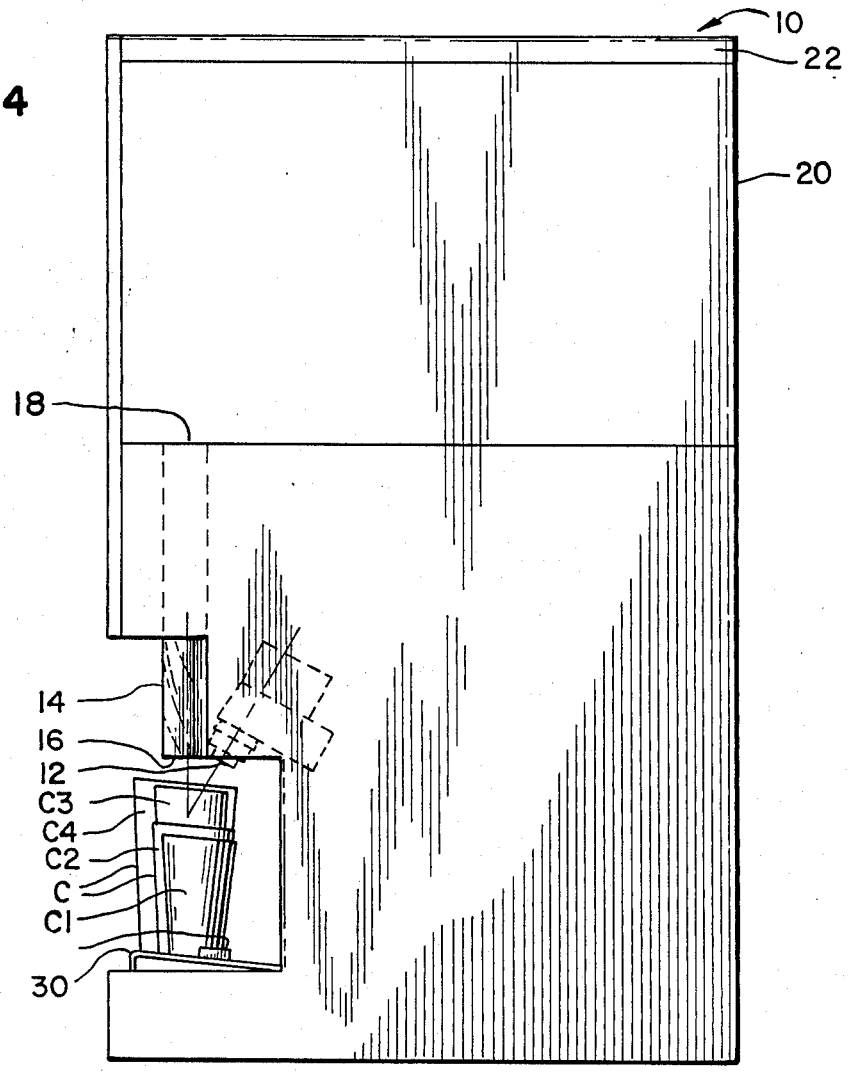
FIG. 4 is a side view of the invention as illustrated in FIG. 1.

Preferably, apparatus 10 is further provided with an inclined rack 30, which provides an inclined surface for supporting cups to be filled under spouts 12 and chutes 14, as shown in FIGS. 3 and 3A. Rack 30 preferably provides an incline of about 7 to 10 degrees, preferably about 8 degrees, from vertical. Rack 30 is positioned beneath dispensing gates 42 and spouts 12 upon which cups C of varying sizes are placed in an inclined position to be filled. Rack 30 is placed in apparatus 10 so as to slope downward from the front to the rear of apparatus 10. Rack 30 is also provided with stops 32 to prevent cups C from sliding down rack 30 as additional weight is placed in cups C as ice bodies I and beverage B are dispensed into cups C. This additional weight creates a force which acts in the direction of the incline. Stops 32 act to counteract this force. Stops 32 may be one of several shapes; a V-shaped stop, as shown in FIG. 3, is preferred. Stops 32 act as a brace to effectively prevent a cup C from falling over as it is being filled.

An agitator 24 is also provided in hopper 20. However, dual agitators 24 are preferred, each agitator 24 being aligned in hopper 20 in a linear path substantially parallel to chutes 14 and spouts 12. Agitators 24 provide at least two functions. A first function is to deliver ice bodies I to upper end 18 of chute 14 so that chute 14 may be refilled when needed. Agitators 24 may have a shaft 24, and paddle wheels 24''. Shaft 24' and paddle wheels 24'' are made to rotate by agitator motor 26. The paths of paddle wheels 24'' may overlap a given area. A second function is to prevent conglomeration of ice in hopper 20 when the agitators 24 are not turned on in a long time.

Agitator 24 is made to rotate by the control system, discussed below, according to predetermined times in view of several factors. One such factor is related to the quantities of ice bodies dispensed from each chute. A second such factor is related to the location of upper end 18 in the base of hopper 20. For example, if a quantity of ice has been dispensed from one of chutes 14 to correspond to an "extra-large" drink, a relatively lesser quantity of ice bodies I may remain in chute 14. Therefore, illustratively, agitator 24 will be rotated for a longer period of time because chute 14 must be refilled with more ice bodies I. Further, it has been determined that the position of upper ends 18 of chutes 14 must be taken into account in refilling chutes 14. For example, in a generally rectangular-shaped hopper 20 as depicted in FIG. 5, upper ends 18 nearest a corner require a longer agitation time for ice bodies I to be delivered to upper ends 18. Also, depending on the configuration of upper ends 18 with respect to agitators 24 in hopper 20, the chute 14 which is nearest the center of the linear path formed by upper ends 18 requires a longer agitation time for ice bodies I to be delivered to the respective upper ends 18. Default values for agitation times corresponding to each upper end 18 are stored in the control system discussed below.

Figure 9:
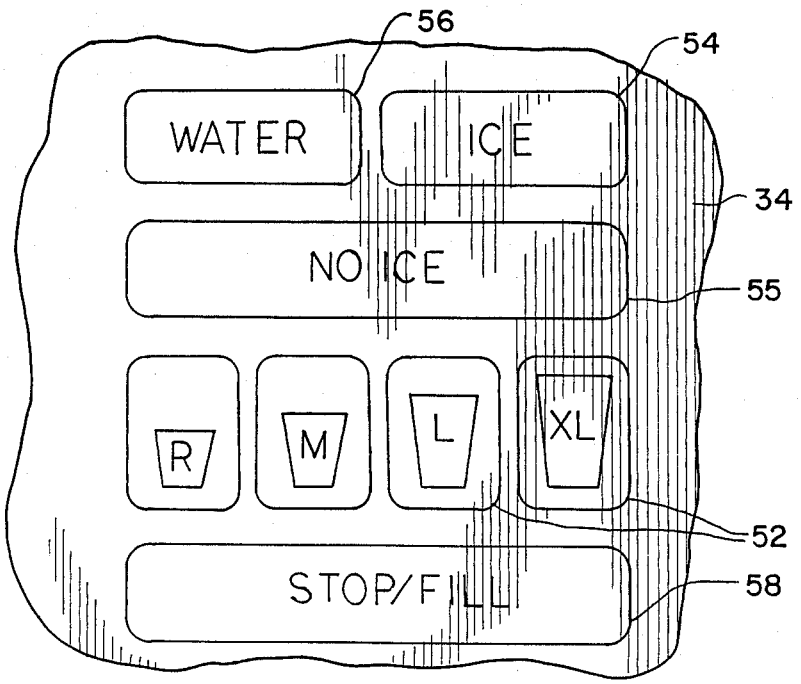
FIG. 9 is a front view of the touch pad control.

The normal operation of apparatus 10 will now be described. A cup of a given, predetermined size is placed on rack 30, against stop 32. The appropriate button on control panel 34 in FIG. 9 is pressed, along with any desired options as provided on control panel 34. The operation of control panel 34 is discussed below. A quantity of ice bodies I is then dispensed vertically through lower end 16 and into cup C.

A quantity of ice bodies I is made to be dispensed through chute 14 according to a proper sequencing of dispensing gate 42 and divider gates 44. As discussed above, the volume in chute 14 between each dispensing gate 42 and divider gates 44 define different, preselected volumes of ice bodies I to be dispensed in a cup C. Before a quantity of ice bodies I is dispensed from chute 14, chute 14 is filled or refilled substantially entirely with ice bodies I. This is accomplished by moving dispensing gate 42 into the second position while all divider gates 44 are in the first position; agitator 24 is then made to rotate for a predetermined time so that ice bodies I are delivered to upper end 18. The delivered ice bodies I fall through chute 14 until chute 14 is substantially filled along its length. After one of size buttons 52 on touch pad control panel 34 is pressed, the corresponding divider gate 44 is also moved to its second position. After the appropriate divider gate 44 is moved to its second position, dispensing gate 42 is moved back laterally to its first position. The quantity of ice bodies I which had been held above dispensing gate 42 and below the selected divider gate 44 falls by gravity, vertically, through chute 14 and out lower end 16 into cup C. After dispensing gate 42 has been moved into its first position for a given time to allow all the ice bodies to fall through chute 14, preferably for a time of one second, dispensing gate 42 is moved back to its second position across chute 14. The selected divider 44 is moved to its first position and chute 14 is again refilled and ice bodies I dispensed according to the same sequence.

As shown in FIG. 4, spout 12 is positioned adjacent to chute 14. Spout 12 is shown in its preferred orientation-inclined at an acute angle relative to vertical. Less foaming and better carbonation retention for carbonated beverages occurs when the beverage spout is at an angle of about 15 degrees from vertical In accordance with the size button 52 pressed on control panel 34, a predetermined quantity of beverage B is dispensed into cup C after the corresponding quantity of ice bodies I have been dispensed into cup C.

The inclined orientation of cup C on rack 30, the position of lower end 16 and spout 12 offers an advantage in assisting the filling of cup C. Specifically, the orientation of these three elements acts to counteract the force which acts on the cup C and its contents in the direction of the downward slope of rack 30. As a quantity of ice bodies I is dispensed and strikes the interior sidewalls of cup C, at least a portion of this quantity tends to gather along the sidewalls of the cup adjacent stop 32. This gathering of ice bodies I at this position creates a horizontal force component in the direction of and against the stop, this force effectively assisting in holding the cup steady during the time that beverage B is dispensed into cup C. Cup C is therefore less likely to fall over as it is being filled or after it has been filled. Also, the horizontal force component urges the cup against the stop and insures that the cup is in proper position for beverage filling. This arrangement has been determined to be more efficient in the filling of cups C than not positioning cups C on an incline without a stop. Particularly, if cups C were placed level and there ice bodies I and beverage B were dispensed into cups C, cups C would tend to move around and also have more of a tendency to tip over during filling.

A method for dispensing ice bodies and beverage B into a cup at a single location is also provided. A cup is first positioned on an incline under a spout for dispensing beverages. A stop is provided on the incline for preventing the cup from sliding down the incline as the cup is being filled. A quantity of ice bodies are then dispensed into a cup from a vertically disposed chute adjacent the spout. The cup had been positioned on the incline to receive the ice bodies at the base of the cup so that the ice bodies tend to gather against the side of the cup adjacent the stop, i.e., at the lower side of the base. The weight of the ice bodies gathered there creates a force component against the stop, which assists in positioning and keeping the cup relatively stationary as the cup is being filled with beverage. The beverage is then dispensed into the cup.

The control system for apparatus 10 will now be described. The control system can be done on a central microprocessor utilizing real-time-based software to control each dispensing location separately. The software has the capacity to handle from 1 to 8 dispensing locations. Central control for the apparatus allows for more accurate timing and control of the dispense times for each dispensing location. Another advantage to central control is the adjustment of dispense times by restaurant personnel from a keyboard (not shown) and individual timer boards for each dispensing location do not have to be accessed. Dispensing times are adjusted by increments and decrements of one-tenth of a second allowing for exact adjustments, all performed at the keyboard. The control system is able to dispense appropriate quantities of ice bodies and beverage to correspond to different drink sizes.

The control system controls several operations: moving the dispensing gate and one of the divider gates between their respective first and second positions to dispense ice bodies in a certain quantity from the chute, dispensing a certain quantity of beverage, and activating the agitator motor for the ice hopper for the amount of time required to refill the chute with ice bodies. The control system also has ice only and no ice options. Further, one or more of the dispensing locations may be equipped with an additional spout for water, with an appropriate water dispensing option.

FIG. 9 shows generally the type of touch pad control panel 34 used by restaurant personnel to fill a certain cup size with beverage. Each dispensing location may be dedicated to one type of beverage. Preferably, more than one beverage may be provided. After a cup of a certain size is positioned appropriately into a dispensing location, one of the four size button switches 52 corresponding to the size of the cup to be filled is activated by pressure. As discussed above, the control system then dispenses an appropriate quantity of ice bodies and beverage. If no beverage is desired, the no ice button 54 is pressed and no beverage is dispensed. If no ice bodies are to be dispensed, the no ice button 55 is pressed and only beverage is dispensed. If water is desired, a water button 56 is pressed and then an appropriate cup size is pushed; as a result, an appropriate amount of ice bodies and water are dispensed.

Also developed into the control system is a program mode. The program mode is used to adjust drink dispense times as well as agitation times. The length of time that a dispense valve is open for any given drink size at any given dispensing location can be adjusted in increments of a tenth of a second. All dispense times have a set of default values that are resident in the system. Dispense times can be set back to their defaults at any time.

In addition to dispense times, the amount of time required to agitate the ice in order to refill a chute with ice after an ice dispense can also be adjusted. The amount of time required to agitate the ice after an ice dispense of a regular at one dispensing location is different than the amount of time required at another dispensing location and so on. The specific times need to be adjusted because a longer agitation time is needed to refill the chutes that are closer to each end of the row of dispensing locations and at the center of the row of dispensing locations. The different agitation times for each location must be taken into account with what quantity of ice bodies has been dispensed to determine an overall agitation time.

Figure 10:
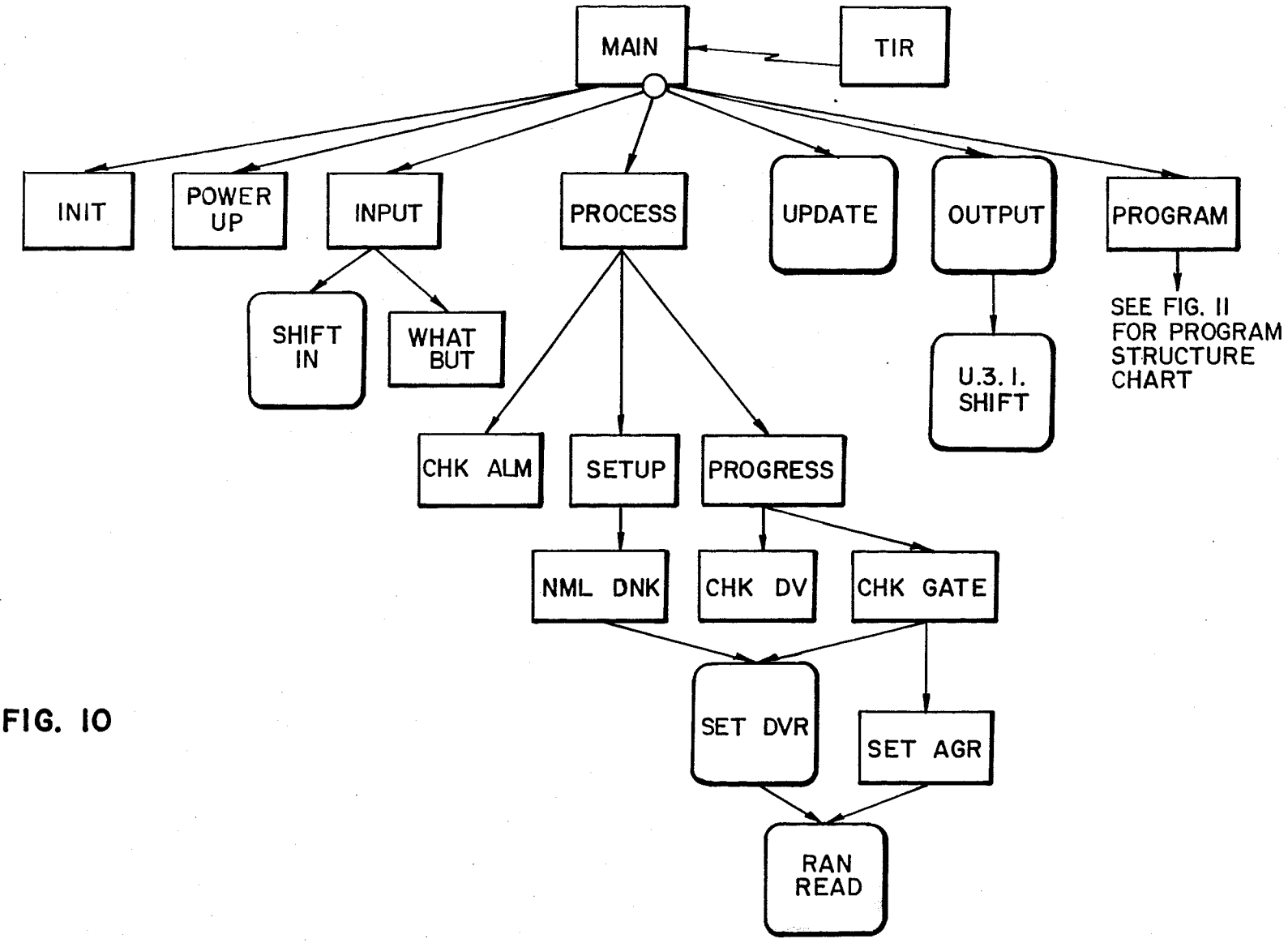
FIG. 10 illustrates the basic structure of the control system.
Figure 11:
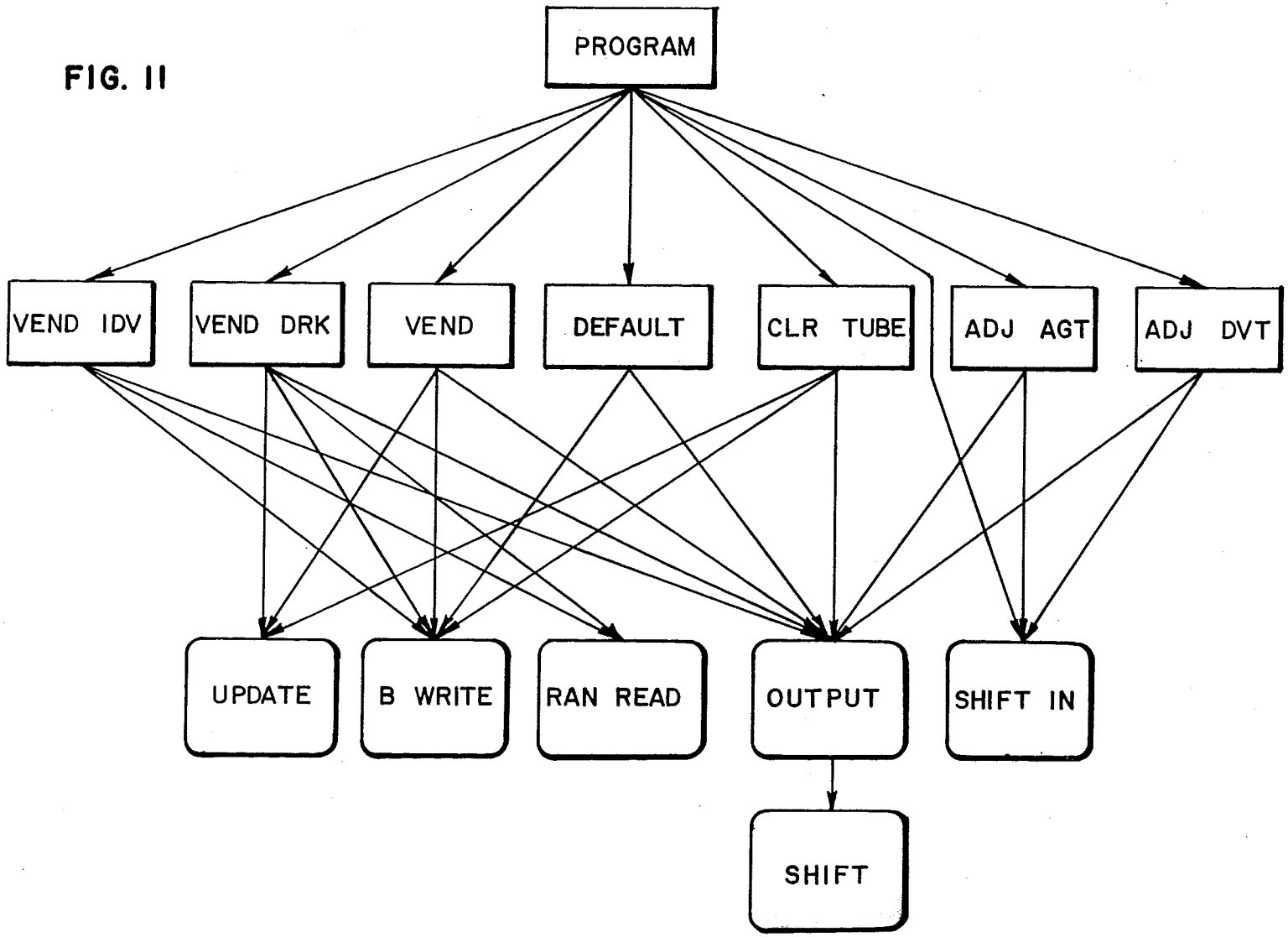
FIG. 11 shows a subroutine for controlling the program mode.

Referring generally to FIGS. 10 and 11, the basic structure of the control system is discussed. FIG. 10 shows the overall structure of the system, with the various subroutines each discussed below. FIG. 11 illustrates in detail the subroutine that controls the program mode.

The control system is based on a CDP6805E3 8-bit microprocessor, 8K of EPROM, 8K of RAM and seven 8-bit shift registers. The microprocessor is controlled by the source code resident in a 2764 8K EPROM. Default times for ice agitation and drink dispensing are also stored in PROM. There are 2 UCN5821A 8-bit shift registers used to shift out drink valve, low conditions, agitate and alarm control valves.

The 8K RAM contains the current drink dispense and agitation times. These times originally start out as the default times, but alteration of these times is possible through the program mode. Every time a drink is dispensed, its current drink time is read from the RAM as well as the agitation time if required. The 8K of RAM has a capacitor back-up and will remain valid for several weeks. Upon power up a validation check is performed on RAM by reading a specific bit string from a specified memory location. If the bit string is not as expected then memory has experienced power loss from the capacitor and default times are read from PROM and written to RAM.

There are 5 UCN4821A 8-bit shift registers to control the 40 ice dispense control bits. There are 5 solenoids, corresponding to four divider gates (i.e., regular, medium, large, extra large size drinks) and a dispensing gate for each of the eight stations. The 8K RAM contains the current drink dispense and agitation times for each of the eight stations.

The software for the drink dispensing system is developed on eight major functions. The major functions being Initialize, Input, Setup, In Progress (shortened to Progress), Update, Output, Timer Interrupt Routine (TIR) and Program Mode. These modules and the modules called by these major functions are discussed below and illustrated in FIGS. 10 and 11.

The structure of the software is based on Input-Process-Output ideology. Since this is a real time application that is constantly running, Input-Process-Output is in an endless loop. Input is accepted from the keyboard, processed and the result is output followed by input-process-output again, and so on.

Since there is one microprocessor processing eight dispensing locations, only one location's status can be processed at a time. The dispensing locations are consecutively numbered from 1 to 8. For example, location 1 is processed during one pass through the loop, followed by station two during the next pass, etc. up to location 8, even if location 8 does not exist, and back to location 1. Therefore, every pass through the continuous loop corresponds to only one station, but all 8 locations' outputs are output each time. Thus, the Update function updates the appropriate output bits for the station just processed prior to calling Output. Note that even if a location is not actively performing a function and is sitting idle, it is still processed when the pass through the loop corresponds to the location. The result is simply no new update of output bits.

The process portion of the Input-Process-Output outline is further divided into two main functions for this application. There are two different types of processing involved in processing a drink for a given location. The first function sets up the appropriate conditions for the second. When a drink size is selected at a given location, it must be determined which drink size was pushed and if NO ICE was requested, among other values. After the appropriate conditions are established in the Setup function, the Progress function is called the next time this location is processed in order to maintain the appropriate conditions, such as keeping the dispensing gate open for 1 second, or keeping the drink valve open for the desired length of time, etc.

The software has a set of timer registers that are maintained by the Timer Interrupt Routine (TIR). The processor is initialized in the INIT routine to be interrupted when the Timer Data Register (TDR) reaches zero. Through a combination of hardware and software initializations, the TDR is decremented every tenth of a second. Therefore, the main Input-Process-Output loop is interrupted every tenth of a second and processes the TIR to maintain the timer registers before returning to where it was interrupted.

The timer registers are made up of three system registers, and 24 station registers. One system register contains the amount of time remaining to complete agitation. When this register is greater than zero, the agitation motor is on; when this register is equal to zero, the motor is off. The remaining two system registers are specialty registers to control an LED flash during a low condition, and to monitor the system for a 15 minute dead period.

The 24 location registers are based on the same philosophy. Each location has three registers corresponding to three different timed functions, agitation remaining to fill the chutes, time remaining to keep the dispensing gate open and divider gate closed, and time remaining to complete drink dispense.

All communication between the processor and other devices is through the use of the 6805's 14 I/0 ports, only 10 of which are being used. The processor communicates with three logical groups, the keyboard for input, the drink valves and solenoids for output, and RAM for timing data. Keyboard communication is via two shift registers controlled through Port B IO lines 2, 3, 4, 5 and 6.

As mentioned previously, only one dispensing location is processed at any given time. Each location is made up of eight switches. The software selects a location through PB5 and proceeds to shift in that location's 8 switch bits: 1 or high for a switch closure, 0 or low for no switch closure. This information is shifted in by the software routine SHIFT_IN and the switch closure information is stored in the byte IO_BITS. The switch closure data is shifted in PB2, by strobing the data into the 4021s with PB3 and clocking the data in PB2 with PB4.

This location's switch information is then processed before the next station or column is selected for its switch information, etc.

Output to the dispensing gates, divider gates, drink spouts and alarm is performed over Port B lines 0, 1 and 7. PB1 is dedicated for data output while PA0 and PA7 are controlling bits for clock and strobe respectively.

The obvious constraint with nearly every real time application is time. Only one station's keys can be checked for a switch closure at a time, therefore each station's keys need to be checked often enough to avoid missing a switch closure.

Along the same line are the outputs. Output status needs to be checked and updated often enough in order to have accurate timing of drink dispense and agitation.

The 8K EPROM memory available for source code is more than enough ROM for the source code. Specifically, the source code currently occupies a little more than one-quarter of the available ROM. The 2764 8K EPROM is used over a smaller EPROM primarily because of cost and availability.

A short description of each of the different modules illustrated in FIGS. 10–11 will now be discussed. TIR has been discussed above, and is a set of timer registers. When the count down timer reaches zero, the processor is interrupted and jumps to this routine. The routine resets the count down timer to 1 and the count down register is decremented every tenth of a second. MAIN is the main program module; all other modules stem from here. INIT initializes all variables for reset or power up and built-in registers are set to required values. POWER_UP performs agitation for 15 seconds upon power up or after exiting from the program mode when an ice dispense was performed. INPUT calls all the modules that are necessary to determine which buttons were pushed on the keyboard for a given station. The value is set to 8 when 0 or greater than 0 buttons are pushed. WHAT_BUT determines which buttons were pushed. PROCESS determines the state of the current dispensing location and calls the appropriate modules. If the station is in progress, then PROGRESS is called. If a button was pushed at this dispensing location, then SETUP is called. Otherwise, the program is continued. CHK_ALM checks the status of values of sensors associated with low conditions (low $CO_2$, low ice). The alarms are turned on or off accordingly. SETUP handles any new buttons being pushed on the keyboard. If the button is a drink size, then various system flags (too many buttons pushed, low $CO_2$, low ice, ice and agitation required) and current dispensing location flags (REG gate, MED Gate, LRG gate, XLRG gate, gate in progress, station in progress, stop bit, no ice) are set up for processing the drink next time around in PROGRESS. NML_DNK sets up the conditions for the dispensing location flags for a normal drink process. In other words, this routine is only executed when a drink size button has been pushed. PROGRESS is the routine called when the divider gate in the progress bit is set in current dispensing location flags. This indicates that the current station is processing a drink. This routine then determines what state it is in (gate, dispense spout or waiting for an agitator to complete so that it may begin a gate). The routine then calls the appropriate modules to process the current state. CHK_DV checks the condition of the drink spout register. The module handles three conditions; on, off, and when the Stop Bit is set. CHK_GATE checks the status of a gate in progress for a given station. Three conditions are checked: on, off, and when the stop bit is set in the current dispensing location flags. SET_AGR loads the appropriate agitation time into that dispensing location's agitation register. PROGRAM is the controlling module for the program mode. Based on the buttons pushed, the appropriate routine is called. This module is further discussed below and is illustrated in FIG. 11. SHIFT_IN shifts in the 8 bits from PA into IO_BITS. UPDATE is used to update the appropriate bytes with the current status dictated by IO_BITS and two variables concerning the current station (one in decimal and the other in a bit station). OUTPUT unloads this data into the generic byte IO_BITS one at a time and passes IO_BITS to SHIFT. In other words, OUTPUT feeds the data for shifting out. SHIFT shifts out the bits in IO_BITS. SET_DVR loads the appropriate value into the current dispensing locations DVR. B_WRITE writes data into RAM stored at the address where the information stored in data is to be written. RAN_READ reads data from RAM stored at this address.

FIG. 11 depicts the Program Mode. As discussed above, PROGRAM is the controlling module for the program mode. VEND_IDV vends ice for the size selected. Bytes are loaded with the appropriate address and time of agitation required for the selected size and station. VEND_DRK vends drink for the amount of time appropriate for the drink size selected. The No Ice cup is to be vended during this process. The dispensing locations drink size valve time is set and is contained in the memory. VEND_4 vends the drink spout for 4 seconds. This 4-second vend is for determining if the drink spouts themselves need an adjustment. DEFAULT sets the last adjusted drink or ice time back to its appropriate default value stored in the RAM. CLR_TUBE clears the chutes of ice. This is done by opening the dispensing gate for one second. No agitation is performed. ADJ_AGT is used to handle the no ice button and ice or water being pushed at the same time for a decrement or increment of the current time stored in memory. If the user attempts to decrement the time below 0, the alarm will not beep and the time is not decremented. ADJ_DVT is used to adjust the drink spout time by using the WATER and ICE button for decrementing and incrementing the time stored in memory.

While the invention is described in connection with preferred embodiments, it will be understood that it is not intended to limit the invention to these embodiments. On the contrary, it is intended to cover all alternatives, modifications and equivalents as may be included in the spirit and scope of this invention as defined by the appended claims.

What is claimed is:

1. A dispensing apparatus for dispensing ice bodies and beverage into a cup at a single cup location, comprising:

a plurality of spouts for dispensing beverages, each said spout capable of dispensing at least one type of beverage and being oriented at an acute angle relative to vertical;

a storage hopper for ice bodies located above said spouts;

a plurality of vertically disposed chutes equal to the number of spouts, each chute having an upper end which communicates with said hopper for receiving ice bodies from said hopper and a lower end for dispensing a predetermined quantity of ice bodies vertically downward into the cup positioned below said chute from said chute, said lower end being associated with one of said spouts to allow both beverage and ice bodies to be dispensed at a single cup location.

for each chute, a plurality of divider gates selectively insertable into said chute at preselected positions intermediate said ends of said chute, each said divider gate being movable between a first, open position in which said chute is substantially clear of said divider gate and a second, closed position in which a portion of said divider gate has been inserted into said chute to prevent or substantially prevent the flow of ice bodies therepast;

a dispensing gate selectively insertable near said lower end of said chute to prevent dispensing of ice bodies from said chute, said dispensing gate and said divider gates, said dispensing gate being movable between a first, open position in which said chute is substantially clear of said dispensing gate and a second, closed position in which a portion of said dispensing gate has been inserted into said chute to prevent the flow of ice bodies out of said chute, the spaces between said dispensing gate and each of said divider gates when said dispensing gate and each of said divider gates are in their respective said second positions defining different, preselected quantities of ice bodies;

means for adjusting said preselected quantities of ice bodies; and means located in said hopper for delivering ice bodies into said chutes.

2. The apparatus according to claim 1, wherein said upper openings of said chutes being aligned along one of the bottom edges of said hopper.

3. The apparatus according to claim 1, wherein said chutes are aligned vertically and substantially parallel to each other.

4. The apparatus according to claim 1 wherein said divider gates comprise solid, planar members that block only a portion of the cross-sectional area of said chute when said divider gates are inserted into said chute.

5. The apparatus according to claim 1 wherein said dispensing gate does not block the entire cross-sectional area of said chute when said dispensing gate is inserted into said chute.

6. The apparatus according to claim 1 wherein said divider gates and said dispensing gate are selectively movable with dual-action pneumatic cylinders.

7. The apparatus of claim 1 wherein said spout is inclined at an angle of about 15 degrees from vertical.

8. The apparatus according to claim 1 wherein said means for delivering ice bodies are activated for a predetermined time when ice bodies are dispensed from one of said chutes.

9. The apparatus according to claim 8 wherein said predetermined time is related to the quantity of ice bodies dispensed from said chute and the location of said upper end of said chute with respect to said hopper.

10. The apparatus according to claim 1 wherein any one of four preselected quantities of ice bodies and beverage may be dispensed.

11. The apparatus according to claim 1 further comprising an inclined rack beneath said dispensing gates and said spouts upon which cups are placed to be filled in an inclined position.

12. The apparatus according to claim 11 wherein said rack includes stops to position cups to be filled at specific locations for filling.

13. The apparatus according to claim 11 wherein said rack is inclined at an angle of about 8 degrees from horizontal.

14. The apparatus according to claim 1 wherein said chute comprises a front panel with slots for said divider gates and said dispensing gates and a semi-cylindrically shaped element which is removably mounted to said front panel.

15. The apparatus according to claim 1 wherein the number of said spouts and said chutes is at least five.

16. A method for dispensing ice bodies and beverage into a cup at a single location, comprising:

positioning the cup on an incline under a spout for dispensing beverages of a dispensing apparatus for dispensing ice bodies and beverage into a cup at a single cup location, said apparatus including a stop in a location relative to the incline so that the cup is in an ice body and beverage receiving location when against the stop, the stop for preventing the cup from sliding down the incline as it is being filled;

dispensing ice bodies from the dispensing apparatus into the cup at said location from a vertically disposed chute, the cup receiving the ice bodies to create a horizontal force component in a direction down the incline and against said stop to assist in keeping the cup relatively stationary as the cup is being filled; and dispensing beverage from the dispensing apparatus into the cup at said location.

17. A dispensing apparatus for dispensing ice bodies and beverage into a cup at a single cup location, comprising:

a plurality of spouts for dispensing beverages, each said spout capable of dispensing at least one type of beverage;

a storage hopper for ice bodies located above said spouts;

a plurality of vertical chutes equal to the number of spouts, each chute having an upper end which communications with said hopper for receiving ice bodies from said hopper and a lower end for dispensing a predetermined quantity of ice bodies from said chute, said lower end being associated with one of said spouts to allow both beverage and ice bodies to be dispensed at a single cup location;

for each chute, at least one divider gate selectively insertable into said chute at a preselected position intermediate said ends of said chute, each said divider gate being movable between a first, open position in which said chute is substantially clear of said divider gate and a second, closed position in which a portion of said divider gate has been inserted into said chute to prevent or substantially prevent the flow of ice bodies therepast, each said divider gate being selectively movable with a dual-action pneumatic cylinder;

a dispensing gate selectively insertable near said lower end of said chute to prevent dispensing of ice bodies from said chute, said dispensing gate and said divider gates, said dispensing gate being movable between a first, open position in which said chute is substantially clear of said dispensing gate and a second, closed position in which a portion of said dispensing gate has been inserted into said chute to restrict the flow of ice bodies out of said chute, the ice bodies segregated in the space in said chute between said dispensing gate and said divider gate when each are in their respective said second positions defining said preselected quantity of ice bodies, each said dispensing gate being selectively movable with a dual-action pneumatic cylinder;

an inclined surface under each said chute for positioning a cup under any one of said chutes and including stops on said inclined surface to prevent at each said cup position a cup from sliding down the incline, the cup being positioned to receive ice bodies dispensed from said chute to allow at least a portion of the ice bodies to strike the interior sidewall of the cup adjacent said stop; and a control system for dispensing said predetermined quantity of ice bodies from each chute corresponding to said predetermined quantity of beverage being dispensed from each spout.

18. A dispensing apparatus for dispensing ice bodies and beverage into a cup at a single cup location, comprising:

a plurality of spouts for dispensing beverages, each said spout capable of dispensing at least one type of beverage, each said spout inclined at an angle of about 15 degrees from vertical;

a storage hopper for ice bodies located above said spouts;

a plurality of vertical chutes equal to the number of spouts, each chute having an upper end which communicates with said hopper for receiving ice bodies from said hopper and a lower end for dispensing a predetermined quantity of ice bodies from said chute, said lower end being associated with one of said spouts to allow both beverage and ice bodies to be dispensed at a single cup location;

means located in said hopper for delivering ice bodies into said chutes;

means associated with said chutes for dispensing a desired amount of ice bodies from said chutes;

an inclined surface under each said chute for positioning a cup under any one of said chutes and including stops on said inclined surface to prevent at each said cup position a cup from sliding down the incline, the cup being positioned to receive ice bodies dispensed from said chute to allow at least a portion of the ice bodies to strike the interior sidewall of the cup adjacent said stop; and a control system for dispensing said predetermined quantity of ice bodies from each chute corresponding to said predetermined quantity of beverage being dispensed from each spout.

19. A dispensing apparatus for dispensing ice bodies and beverage into a cup at a single cup location, comprising:

a plurality of spouts for dispensing beverages, each said spout capable of dispensing at least one type of beverage, each said spout inclined at an acute angle relative to vertical;

a storage hopper for ice bodies located above said spouts;

a plurality of vertical chutes equal to the number of spouts, each chute having an upper end which communicates with said hopper for receiving ice bodies from said hopper and a lower end for dispensing a predetermined quantity of ice bodies from said chute, said lower end being associated with one of said spouts to allow both beverage and ice bodies to be dispensed at a single cup location;

means located in said hopper for delivering ice bodies into said chutes;

means associated with said chutes for dispensing a desired amount of ice bodies from said chutes;

an inclined surface under each said chute for positioning a cup under any one of said chutes and including stop son said inclined surface to prevent at each said cup position a cup from sliding down the incline, the cup being positioned to receive ice bodies dispensed from said chute to allow at least a portion of the ice bodies to strike the interior sidewall of the cup adjacent said stop; and a control system for dispensing said predetermined quantity of ice bodies from each chute corresponding to said predetermined quantity of beverage being dispensed from each spout.

* * * * *

UNITED STATES PATENT AND TRADEMARK OFFICE

CERTIFICATE OF CORRECTION

PATENT NO. : 4,946,073

DATED : August 7, 1990

INVENTOR(S) : Brill et al.

It is certified that error appears in the above-identified patent and that said Letters Patent is hereby corrected as shown below:

On title page, item [75], "Doulgas" should read --Douglas--.

Abstract, line 2, delete "throuch" and insert therefor --through--; and line 10, delete "off" and insert therefor --of--.

Col. 4, line 42, delete "occurs" and insert therefor --occur--.

Col. 7, line 55, after "divider" insert --gates--.

Col. 8, line 4, delete "Dispensing-gate" and insert therefor --Dispensing gate--.

Col. 9, line 44, delete "24," and insert therefor --24'--.

Col. 11, line 66, delete "the no" and insert therefor --an--; and

Col. 12, line 14, before "dispense" insert --adjustable--.

UNITED STATES PATENT AND TRADEMARK OFFICE

CERTIFICATE OF CORRECTION

PATENT NO. : 4,946,073

DATED : August 7, 1990

INVENTOR(S) : Brill et al.

It is certified that error appears in the above-identified patent and that said Letters Patent is hereby corrected as shown below:

Col. 16, line 19, after "location" delete the period "." and insert therefor a semicolon --;--.

Col. 20, line 7, delete "stop son" and insert therefor --stops on--.

Signed and Sealed this

Thirtieth Day of March, 1993

*Attest:*

STEPHEN G. KUNIN

*Attesting Officer*

*Acting Commissioner of Patents and Trademarks*